United States Patent [19]

Andersen

[11] 4,330,101

[45] May 18, 1982

[54] BASKETBALL BACKBOARD SUPPORT APPARATUS

[75] Inventor: Frank L. Andersen, Logan, Utah

[73] Assignee: Equalizer, Inc., Logan, Utah

[21] Appl. No.: 89,945

[22] Filed: Oct. 31, 1979

[51] Int. Cl.[3] ..... E04G 3/00; A63B 63/00

[52] U.S. Cl. ..... 248/284; 273/1.5 R

[58] Field of Search ..... 248/284, 291, 292.1, 248/293, 562, 567, 280.1; 211/100; 273/1.5 R, 1.5 A; 52/111

[56] References Cited

U.S. PATENT DOCUMENTS

| | | | |
|---|---|---|---|
| 1,320,613 | 11/1919 | Gilcrease | 403/105 X |
| 1,926,674 | 9/1933 | Gross | 273/1.5 R |
| 2,227,310 | 12/1940 | Hoppes et al. . | |
| 2,228,592 | 1/1941 | Curtis | 403/105 X |
| 2,372,705 | 4/1945 | Bicker | 403/105 X |
| 2,757,888 | 8/1956 | Branstrator . | |
| 2,831,689 | 4/1958 | Marsh | 273/1.5 R |
| 3,184,207 | 5/1965 | Hermanns et al. . | |
| 3,462,102 | 8/1969 | Rivers . | |
| 3,586,324 | 6/1971 | Bearson . | |
| 3,802,702 | 4/1974 | Pulley | 273/1.5 R |
| 3,880,392 | 4/1975 | Duganich | 273/1.5 X |
| 4,114,764 | 9/1978 | Rich | 211/101 X |

FOREIGN PATENT DOCUMENTS

| | | | |
|---|---|---|---|
| 44-5893 | 6/1969 | Japan . | |
| 275125 | 5/1951 | Switzerland . | |
| 576890 | 6/1976 | Switzerland | 248/284 |
| 908055 | 10/1962 | United Kingdom . | |
| 1152846 | 5/1969 | United Kingdom . | |

*Primary Examiner*—J. Franklin Foss

*Attorney, Agent, or Firm*—M. Ralph Shaffer

[57] ABSTRACT

A new and improved basketball backboard support apparatus wherein, to stationary support structure, a unique basketball backboard support structure is coupled. Specifically, stationary support structure is provided which can be attached to and/or suspended from a vertical upright, a wall or other support. The backboard itself includes support structure which is coupled to the stationary support structure by arm means generally taking the form plural, parallel arms having pivot connections at the respective ends. These arms allow for maintenance of the backboard support structure in a vertical plane and yet vertical adjustment thereof. Means are employed to releasably position the backboard support structure at a chosen vertical height, and also for automatically braking descents of the backboard support structure during adjustment intervals. A telescoping brace used in the structure is employed to releasably fix vertical disposition of the backboard support structure, this preferably by a pawl and/or adjustment screw device.

7 Claims, 7 Drawing Figures

BASKETBALL BACKBOARD SUPPORT APPARATUS

FIELD OF INVENTION

The present invention relates to basketball backboards supports and, more particularly, provides a useful combination wherein the basketball backboard support structure employed is vertically adjustable and coupled to stationary support structure, this by selected arm means which are themselves adjustable as to orientation. Means is provided for releasably fixing the relative vertical disposition of the basketball backboard support structure relative to the stationary support structure to which it is connected. Provision is likewise made for incorporating controlled braked descent of the backboard support structure during periods of adjustment thereof. Stop means may actually be used to delimit the lowermost position of the backboard support structure relative to the remaining structure.

DESCRIPTION OF PRIOR ART

Certain prior patents teach structures which can be adjusted for varying the vertical disposition of basketball backboards and similar structures and, hence, relate somewhat to the present invention. These patents are as follows:

| U.S. PAT. NO. | |
|---|---|
| 3,802,702 | 2,757,888 |
| 2,227,310 | 3,462,102 |
| 3,586,324 | 3,184,207 |

| FOREIGN PATENTS | |
|---|---|
| 908,055 | Great Britain |
| 1,152,846 | Great Britain |
| 275,125 | Switzerland |
| 44-5893 | Japan |

U.S. Pat. No. 3,802,702 teaches a concept of a pair of mutually spaced vertical frames that are connected together by opposite sets of arms that move in tandem and in parallel during adjustment intervals. A central brace is adjustable to releasably fix the length of the brace and hence the position of the forward frame supporting the backboard relative to the rear frame that is attachable to an upright standard. Contra the present invention, there is no provision by way of fluid cylinder such as an air cylinder for controlling or braking descents of the backboard attached structure during adjustment intervals, as a consequence of which there may conceivable be some danger to the users or players utilizing the equipment.

The remaining patents likewise bear upon the adjustment feature as to releasably fixed adjustment of one structure relative to another, both for basketball hoops and otherwise. The present invention differs from all the above in the provision not only of an adjustment feature, for effecting desired vertical adjustment of the basketball hoop and support structure, but also in automatically providing braked descent of the backboard structure during adjustment intervals. This prevents jarring and also inadvertent rapid descents which might contribute to a dangerous condition to players and/or other personnel nearby.

BRIEF DESCRIPTION OF THE INVENTION

According to the present invention, there is provided a stationary support structure that is connected to a vertical upright, to a wall, or other fixed structure. Basketball backboard support structure is likewise provided, the same being connected by arm means to a stationary support structure, this in the manner so as to allow for continuous vertical disposition as to the backboard relative to its planar orientation, an also adjustment as to the vertical position of the backboard support structure relative to the stationary support structure.

Means is provided for releasably fixing the vertical disposition of such backboard support structure relative to the stationary support structure. Also, fluid cylinder means are employed for braking backboard support structure descents during adjustment intervals. Spring-biased pawl structure, in one form of the invention, is used to releasable fix the length of bracing structure employed, where used. Means are provided for permitting elevation of the backboard support structure subsequent to lowerings thereof.

OBJECTS

Accordingly, a principal object of the present invention is to provide improved basketball backboard support apparatus.

A further object is to provide basketball backboard support apparatus wherein backboard support structure, linked to stationary support structure, can be adjusted as to vertical orientation, releasably locked in place, and yet have fluid cylinder means providing for controlled descent of the backboard support structure during adjustment intervals or at other times.

A further object is to provide suitable structure for adjusting and also braking movements of a backboard support structure relative to stationary support structure to which it is connected.

BRIEF DESCRIPTION OF DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 1:
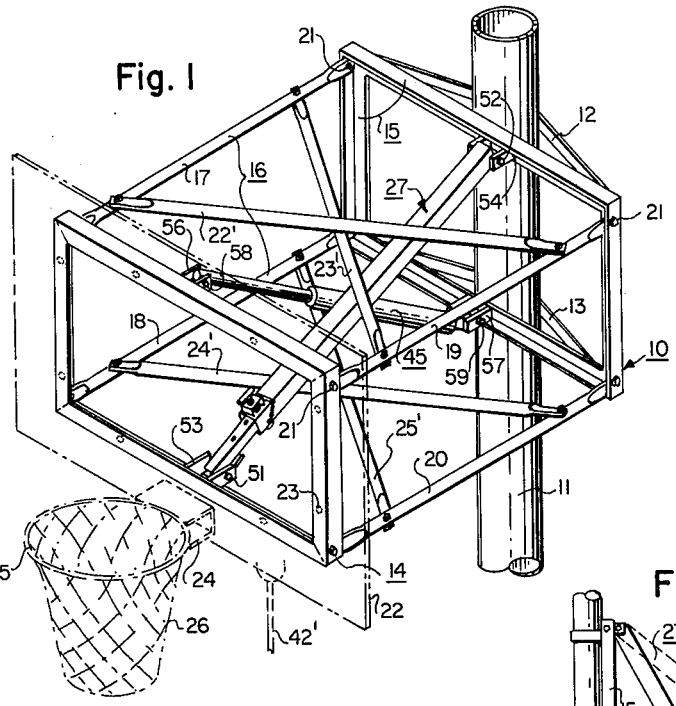
FIG. 1 is a perspective view of basketball backboard apparatus constructed in accordance with one form of the present invention.

In FIG. 1 a basketball back-board support apparatus 10 is shown to be anchored to upright standard 11 by means of welded braces 12 and 13 and/or suitable attachments. The upright standard 11 may, of course, be replaced by simply a vertical wall or other suitable fixed structure.

Apparatus 10 is shown to include a basketball back-board support structure 14 and also stationary support structure 15, both of the structures 14 and 15 comprising in the embodiment shown, a pair of rectangular frames. These frames are coupled together by arm means 16 taking the form of respective pairs of arms 17, 18, and 19, 20 disposed on opposite sides of the respective frames as shown in FIG. 1, such arms being provided with pivot means 21 disposed at opposite ends of each of the arms pivotally securing the arms, functioning as parallel links, to the structures 14 and 15. Cross braces 22'–25° may be rigidly secured, if desired, to the arms 17–20 as indicated.

Accordingly, in the embodiment shown, the support structure 14 can be raised and lowered, as hereinafter described, the arm pairs 17–18 and 19–20 being parallel to each other and forming with the respective sides of structures 14 and 15, parallelograms. The back-board 22, shown for convenience of illustration in FIG. 1 in phantom lines, will be secured by any conventional attachments, at apertures 23, to support structure 14; also, to the back-board 22 will be fastened a bracket 24 that secures basketball hoop 25 and net 26 in place.

A releasable fixing means, for releasably fixing or predetermining the particular elevation of the back-board, is shown at 27 in FIG. 1 to comprise a telescoping brace.

Telescoping brace includes an outer member 28 into which inner member 29 telescopes. The inner member 29 includes a series of apertures 30 designed for the selective reception of reduced end 31 of turn-down bolt 32. The latter is provided with handle 33, see FIG. 5. While not necessarily employed, nonetheless a spring 34 may surround the bolt 32, comprise a compression spring, and engage both the inner upper surface 35 of member 28 and also the top surface 36' of member 29, this for taking up any interior slack as well as providing a frictional force against the upper surface of member 29.

Importantly, and as part of a ratcheting means, member 28 includes a cross bar 36 that is welded in place and which receives the upper ends of each of two springs 37 and 38. The lower ends of these springs engages a pin 39 which is carried in opposite slots 40 of member 28. Pin 39 itself carries a pawl or ratchet member 41 which itself includes protuberance 42 that selectively engages a respective lower aperture 43 of member 29. The pawl or ratchet member 41, thus, selectively releasably positions the telescoping members of FIG. 2 and hence adjustably determines the length of the telescoping brace 27. Pawl 41 may be so formed that the lifting up of back-board 22 by member 42° will automatically effect an automatic disengagement of pawl 41 from a particular aperture 43 to engage an adjacent aperture 43, rendering the brace dimensionally shorter for the higher position now assumed by the back-board 22. At its shortest dimension, a tongue 44 secured to inner telescoping member 29 may be designed and the pawl configured so that the tongue 44 will push out of position and over-toggle the pawl 41 relative to its pivot point so that the back-board 22 can be lowered and the pawl reset in the desired aperture 43.

Figure 3:
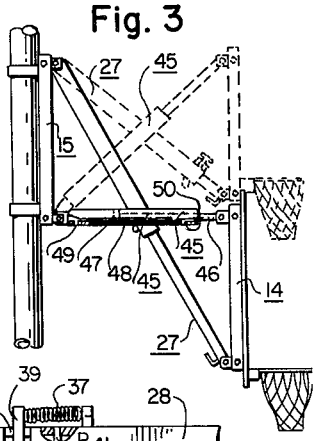
FIG. 3 is a left side elevation in reduced scale showing, in dotted lines, an uppermost position of the basketball backboard and its associated structure and, in solid lines, a lowermost position thereof.
Figure 4:
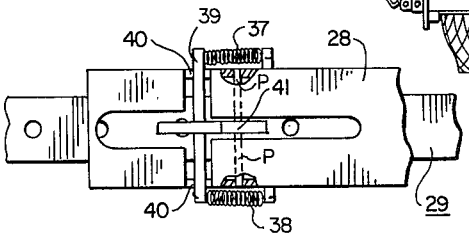
FIG. 4 is a fragmentary detail in enlarged scale and taken as a bottom view along the line 4—4 in FIG. 5.

An important contribution to the present invention is the provision of braking structures such as that shown at 45 in FIGS. 1 and 3. This braking structure takes the form of a telescoping fluid cylinder having piston rod 46, piston 47 and cylinder 48. In a preferred form of the invention, the cylinder 48 will comprise an air cylinder having a small metering aperture 49 on one side of the working piston 47 and an enlarged aperture 50 at the opposite end of this cylinder. Thus, air is easily exhausted to the right of the piston out of aperture 50, facilitating backboard left, but is only gradually exhausted upon backboard descent, when coming out of a metering aperture or pinhole as at 49. The fluid brake at 45 thus controls or brakes the descent of the back-board 22 relative to stationary support structure 21 should either the pawl become inadvertently dislodged from an associated aperture 43 or in any event, where the support structure 14 is allowed to drop to a new position.

Accordingly, the effect of gravity upon the basketball board and its attachment will be essentially counterbalanced or braked by the action of air cylinder 45. The latter serves somewhat as the air cylinder on a screen door to keep the same from closing too abruptly by virtue of a spring pressure applied to such door.

Figure 2:
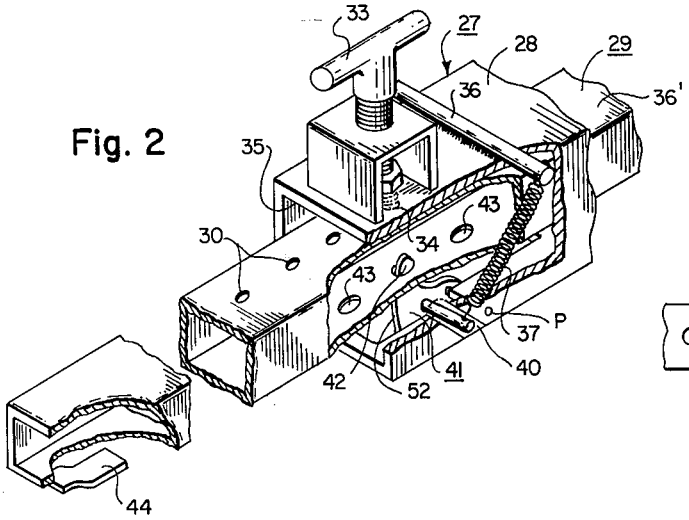
FIG. 2 is an enlarged fragmentary perspective, partially in section, of a central or medial portion of the telescoping brace used in the apparatus of FIG. 1.

The structure above described is fail-safe in the provision of the two springs 37 and 38 and their positive anchoring to cross bar 36, welded in place to member 28 as shown in FIG. 2, and to the pin extremities of pin 39.

Opposite extremities of the telescoping brace are pivoted by pivot means 51 and 52 to frame clevis attachments 53 and 54.

In operation basketball back-board support structure 14 is raised or lowered by screwing out the bolt 32 so that end 31 thereof dislodges relative to a particular aperture 30 and, in addition, by withdrawing pawl 41 from engaging with a specific aperture 43. So long as bolt end 31 is not in engagement with any of the apertures 30, such pawl dislodgement can easily be accomplished by sloping the leading edge 52 of the pawl and then simply raising the back-board 22 by means of an exterior support 42'.

Accordingly, once the proper vertical position of the back-board is achieved relative to fixed standard 11, then the pawl will be allowed to drop in place in one of the respective apertures 43 and, if desired, the locking member 33 tightened down so that the tip 31 of the bolt or screw 32 comes into engagement with an in-line aperture 30. Conceivably, the additional lock provided in the form of member 33 can be simply eliminated from the structure for cost purposes if desired.

The important point, however, is that where the back-board 22 experiences descents, then the progressive retraction of the air cylinder and piston combination will be accompanied by a slow expulsion of air from the left hand side of the cylinder 48 in FIG. 3, whereby to slow or brake such descent and eliminate jarring or danger to players or other users.

For truly effective operation of the device, it is preferred that the shortest dimension of the telescoping air cylinder, see FIG. 3, will exist at the lowest position of the back-board relative to the upright and its stationary support structure. Accordingly, during all vertical travel from the uppermost position of the back-board to its lowermost position, the telescoping air cylinder will operate to expell air out of the metered aperture or pin hole 49 to thus effectively brake the descent of the back-board. A convenient way to accomplish this is to attach one end of the cylinder to the bottom of the stationary support structure to the left, and then the right side of the telescoping cylinder to an upper portion of the back-board support structure 14. See FIG. 3. The telescoping air cylinder 45 can be secured to the respective frames 14 and 15 by the clevises 56 and 57 as shown with their respective pivots 58 and 59.

Figure 5A:
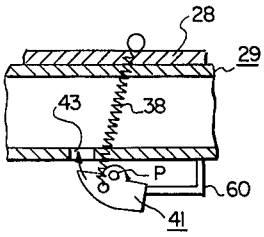
FIGS. 5A and 5B are fragmentary enlarged details, taken along the arcuate line 5A in FIG. 5, and showing pawl re-engagement and pawl disengagement, respectively.
Figure 5B:
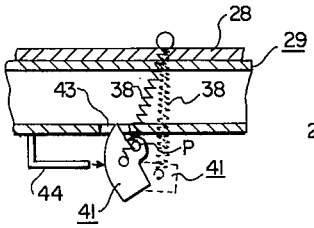
Figure 5:
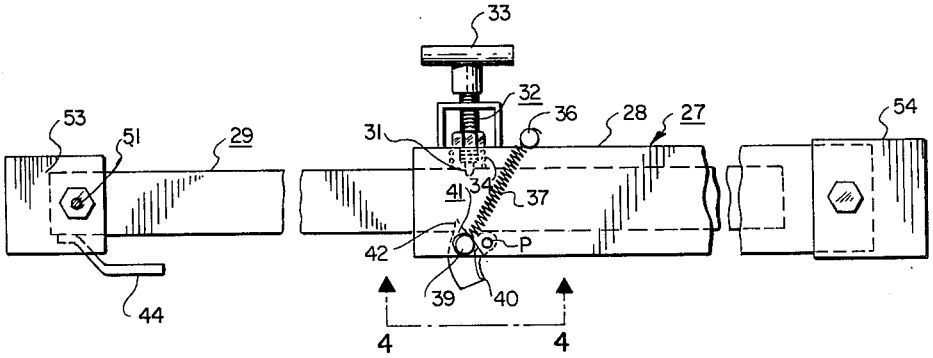
FIG. 5 is a right side elevation of the telescoping brace employed, a portion of which is shown in FIG. 2.

As to FIGS. 5A and 5B, member 29 may be provided with a toe or other abuttment 60 which, when the telescoping brace 27 is approaching its largest dimension, such member or element 60 will thrust the pawl forwardly about pin P of member 28 so that the pawl reengages a selected aperture 43. At the other extremity, element 44 comes into play, see FIG. 5B, so as to dislodge the engagement of the pawl with its respective aperture so that the pawl over-toggles to the dotted line configuration shown, see 41 and 38, whereby the backboard is now free to descend without pawl interference with the several apertures.

It will be understood that while four arms 17–20 have been disclosed, any number of arms from one up can be employed to articulatively secure the front frame or structure 14 with the rear structure 15. Likewise, the length of the telescoping brace or simply the clevis or length of the inner telescoping member may be employed as an automatic stop, or even element 44 can serve this function.

Cylinder 45 may be any type of fluid cylinder, pneumatic of hydraulic, so designed to effect the same function.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In combination, basketball backboard support structure, stationary support structure, arm means coupled between and pivoted to each of said support structures for adjustably connecting said backboard support structure to said stationary support structure whereby said backboard support structure can be raised and lowered relative to said stationary support structure, means for releasably fixing the vertical disposition of said backboard support structure relative to said stationary support structure, and fluid cylinder means for braking backboard support structure descents relative to said stationary support structure, and wherein said releasably fixing means comprises a telescoping brace provided with ratchet means, automatically actuatable through lifting said backboard support structure, for releasably shortening the length of said brace.

2. The combination of claim 1 wherein said brace is pivotally coupled to and between said support structures.

3. The combination of claim 1 wherein said ratchet means includes a spring-biased pawl releasably interengaging component parts of said brace.

4. In combination, basketball backboard support structure, stationary support structure, arm means coupled between and pivoted to each of said support structures for adjustably connecting said backboard support structure to said stationary support structure whereby said backboard support structure can be raised and lowered relative to said stationary support structure, means for releasably fixing the vertical disposition of said backboard support structure relative to said stationary support structure, and fluid cylinder means for braking backboard support structure descents relative to said stationary support structure, and wherein said fluid cylinder means comprises an air cylinder having a metered opening proximate one extremity and a larger opening at the remaining extremity, and a piston operably disposed in said cylinder, having a piston rod extending outwardly therefrom, and operatively movably disposed between said openings.

5. In combination, basketball backboard support structure, stationary support structure, means coupled to and between said support structures for permitting vertical adjustment of said backboard support structure relative to said stationary support structure, and ratchet means automatically activated upon progressive elevation of said backboard support structure relative to said stationary support structure for releasably and permissably re-setting such elevation at one of several predetermined points, said ratchet means being provided with engagement means for automatically rendering, at greatest elevation of said backboard support structure, said ratchet means inoperative, whereby to permit said backboard support structure to be lowered to a lowermost position.

6. The combination of claim 5 wherein said backboard support structure includes means for automatically reactivating said ratchet means at a lower position of said backboard structure relative to said stationary support structure.

7. In combination, basketball backboard support structure, stationary support structure, arm means coupled between and pivoted to each of said support structures for adjustably connecting said backboard support structure to said stationary support structure whereby said backboard support structure can be raised and lowered relative to said stationary support structure, means for releasably fixing the vertical disposition of said backboard support structure relative to said stationary support structure, and fluid cylinder means for braking backboard support structure descents relative to said stationary support structure, wherein said arm means comprise plural, parallel, adjustable arms, wherein said releasably fixing means comprises a telescoping brace provided with ratchet means for releasably fixing the length of said brace, wherein said ratchet means includes a spring-biased pawl releasably interengaging component parts of said brace, wherein, when said backboard support structure is at its lowest position, said brace means is its shortest overall length, and wherein are included means for predetermining the lowest position of said backboard support structure relative to said stationary support structure.

* * * * *